US009561543B2

(12) United States Patent
Shimizu et al.

(10) Patent No.: US 9,561,543 B2
(45) Date of Patent: Feb. 7, 2017

(54) METHOD FOR MANUFACTURING METAL POWDER

(71) Applicant: Shoei Chemical Inc., Tokyo (JP)

(72) Inventors: Fumiyuki Shimizu, Tosu (JP); Masayuki Maekawa, Tosu (JP); Tomotaka Nishikawa, Tosu (JP)

(73) Assignee: SHOEI CHEMICAL INC., Tokyo (JP)

( * ) Notice: Subject to any disclaimer, the term of this patent is extended or adjusted under 35 U.S.C. 154(b) by 210 days.

(21) Appl. No.: 14/391,269

(22) PCT Filed: Apr. 10, 2013

(86) PCT No.: PCT/JP2013/060786
§ 371 (c)(1),
(2) Date: Oct. 8, 2014

(87) PCT Pub. No.: WO2013/157454
PCT Pub. Date: Oct. 24, 2013

(65) Prior Publication Data

US 2015/0101454 A1 Apr. 16, 2015

(30) Foreign Application Priority Data

Apr. 20, 2012 (JP) ..... 2012-096480

(51) Int. Cl.
*B22F 9/06* (2006.01)
*B22F 9/14* (2006.01)
(Continued)

(52) U.S. Cl.
CPC . *B22F 9/14* (2013.01); *B22F 9/06* (2013.01); *B22F 9/12* (2013.01); *H05H 1/48* (2013.01);
(Continued)

(58) Field of Classification Search
None
See application file for complete search history.

(56) References Cited

U.S. PATENT DOCUMENTS 4,689,075 A * 8/1987 Uda ..... B01J 10/005 264/10
6,379,419 B1 * 4/2002 Celik ..... B01J 12/002 75/10.19
(Continued)

FOREIGN PATENT DOCUMENTS

CN 101045611 10/2007
CN 101450384 6/2009
(Continued)

OTHER PUBLICATIONS

Supplementary European Search Report issued Jan. 12, 2015 for the corresponding European Application No. EP13777813.
(Continued)

*Primary Examiner* — George Wyszomierski
(74) *Attorney, Agent, or Firm* — Lucas & Mercanti, LLP

(57) ABSTRACT

A method for manufacturing metal powder includes: melting at least a portion of a metal starting material in a reaction vessel by utilizing plasma so as to form molten metal; evaporating the molten metal so as to produce a metal vapor; and transferring the metal vapor from the reaction vessel to a cooling tube together with a carrier gas supplied into the reaction vessel so as to cool the metal vapor, and condensing the metal vapor in the cooling tube, thereby producing metal powder. The method further includes supplying an oxygen gas into the reaction vessel.

8 Claims, 2 Drawing Sheets

(51) Int. Cl.
*B22F 9/12* (2006.01)
*H05H 1/48* (2006.01)
*B22F 3/00* (2006.01)

(52) U.S. Cl.
CPC ..... *B22F 3/003* (2013.01); *B22F 2999/00* (2013.01); *H05H 2001/483* (2013.01)

(56) References Cited

U.S. PATENT DOCUMENTS

| | | | | |
|---|---|---|---|---|
| 6,479,108 | B2 * | 11/2002 | Hariharan | B29C 33/58 427/446 |
| 7,520,914 | B2 * | 4/2009 | Celik | B22F 1/0088 75/10.19 |
| 2003/0196513 | A1 | 10/2003 | Phillips | |
| 2008/0055818 | A1 * | 3/2008 | Celik | C22C 1/04 361/305 |

FOREIGN PATENT DOCUMENTS

| | | | |
|---|---|---|---|
| CN | 102837002 | | 12/2012 |
| EP | 220420 | | 5/1987 |
| EP | 2789414 | E | 10/2014 |
| JP | H08246010 | | 9/1996 |
| JP | 2001-098309 | A | 4/2001 |
| JP | 2002-530521 | A | 9/2002 |
| JP | 2003-522835 | A | 7/2003 |
| JP | 2004-36005 | | 2/2004 |
| JP | 3541939 | | 4/2004 |
| JP | 2005-097654 | A | 4/2005 |
| JP | 2005-307229 | A | 11/2005 |
| JP | 3938770 | | 4/2007 |
| JP | 2007191772 | | 8/2007 |
| JP | 2006-265635 | A | 10/2008 |
| WO | 0010756 | A | 3/2000 |

OTHER PUBLICATIONS

International Preliminary Report on Patentability, International Application No. PCT/JP2013/060786. Date of Issuance: Oct. 21, 2014 in Japanese and an English translation therof (total pages 11 pages).

* cited by examiner

METHOD FOR MANUFACTURING METAL POWDER

CROSS REFERENCE TO RELATED APPLICATION

This Application is a 371 of PCT/JP2013/060786 filed on Apr. 10, 2013 which, in turn, claimed the priority of Japanese Patent Application No. JP2012-096480 filed on Apr. 20, 2012 both applications are incorporated herein by reference.

TECHNICAL FIELD

The present invention relates to a manufacturing method of metal powder for manufacturing metal powder having low impurity by a plasma technique.

BACKGROUND ART

In manufacturing electronic components such as electronic circuits, circuit boards, resistors, capacitors and IC packages, conductive metal powder is used to form conductor films and electrodes. The characteristics and properties/conditions required for this kind of metal powder include low impurity, fine powder having an average particle diameter of about 0.01 to 10 μm, uniformity in particle shape and particle diameter, little cohesion, excellent dispersibility in paste and excellent crystallinity.

Recently, conductor films and electrodes have been thinner and finer-pitch as electronic components and circuit boards have reduced in size, so that finer spherical metal powder having high crystallinity has been demanded.

As one of methods for manufacturing such fine metal powder, there are known plasma techniques of, after melting and evaporating a metal starting material in a reaction vessel by utilizing plasma, transferring the metal vapor from the reaction vessel to a cooling tube together with a carrier gas so as to cool the metal vapor, and condensing the metal vapor in the cooling tube, thereby obtaining metal powder. (Refer to Patent Literatures 1 to 3.)

These plasma techniques condense the metal vapor in a gas phase, thereby being capable of manufacturing fine spherical metal powder having low impurity and high crystallinity.

FIG. 2 shows an example of a device used in a plasma technique. This is a transferred DC arc plasma device 101 using DC arc, as with Patent Literature 1. The device 101 melts a metal starting material at a crucible part 109 of a reaction vessel 102 so as to form molten metal 108; evaporates the molten metal 108; and transfers the produced metal vapor to a cooling tube 103 by a carrier gas, and cools and condenses the metal vapor in the cooling tube 103, thereby producing metal particles.

The carrier gas is a mixture of a plasma gas and a dilute gas, which is supplied as needed, and usually an inert gas or a reducing gas is used therefor. Examples thereof include argon, helium, nitrogen, ammonia, methane, and a mixture of any of these. A plasma torch 104, an anode 105, a cathode 106, plasma 107 and a dilute gas supply unit 110 shown in FIG. 2 are respectively the same as a plasma torch 4, an anode 5, a cathode 6, plasma 7 and a dilute gas supply unit 10 shown in FIG. 1 described below.

In the case where metal powder is manufactured by a plasma technique, not only for a base metal which is easily oxidized but also for a precious metal which is hardly oxidized, an oxygen gas is not usually used as a carrier gas.

This is because problems arise thereby. For example, by introduction of oxygen into a reaction vessel, an oxide film is produced on the surface of molten metal and consequently manufacturing efficiency decreases, or a heat insulating material of the reaction vessel, such as graphite, is burned; and by presence of a large amount of oxygen in the reaction vessel, plasma properties change and become unstable, and consequently the manufacturing efficiency worsens and also plasma cannot ignite in the end. There is also a problem that, in DC plasma, an electrode metal is oxidized and deteriorates.

For these reasons, for example, even in the case where an oxide coating is to be formed on the surface of metal powder in order to improve oxidation resistance and prevent sintering, oxidation has needed to be carried out not by introducing an oxidized gas into a reaction vessel but, as described in Patent Literature 2 and so forth, by blowing an oxidized gas after producing metal powder by transferring a metal vapor to a cooling tube and condensing the metal vapor, for example.

RELATED ART LITERATURES

Patent Literatures

Patent Literature 1: Japanese Patent No. 3541939

Patent Literature 2: Published Japanese Translation of PCT International Publication for Patent Application No. 2003-522835

Patent Literature 3: Japanese Patent No. 3938770

SUMMARY OF THE INVENTION

Problems to be Solved by the Invention

By the way, in plasma devices as those described in the above patent literatures, temperature in a reaction vessel is extremely high, and also temperature of molten metal is a high temperature of, for example, several thousand degrees. Hence, as material which constitutes a reaction vessel, a refractory material is used as described in Patent Literature 1. Examples thereof include: carbides such as graphite and silicon carbide; oxides such as magnesia, alumina and zirconia; nitrides such as titanium nitride and boron nitride; and borides such as titanium boride.

It is known, however, that even when this kind of refractory material is used, due to long time operation, components of the material, which constitutes a reaction vessel such as a crucible, partly evaporate and get mixed as impurities in metal powder to be produced, which changes quality of a product. (Refer to Patent Literature 3.)

For example, in the case where nickel powder is manufactured, even if a ceramic crucible made of stabilized zirconia, which is a stable refractory material having extremely high heat resistance, is used, it is unavoidable that the components contained in the crucible material, such as zirconium, calcium, magnesium, yttrium, hafnium and silicon, get mixed in the nickel powder. According to studies of the present inventors, this is considered because, particularly at a part which contacts molten metal, such as a crucible part ("crucible" hereinafter) which holds molten metal, the components of the crucible are partly eluted therefrom and dissolve in the molten metal, and get mixed as impurities in the metal powder to be produced.

Further, the mixed-in amount of impurities changes according to the temperature of the molten metal and operation time of a device, which causes variation in impurity level of products. Still further, the elution of the components of the crucible also changes material quality of the crucible, which causes decrease in durability of the crucible, and hence another problem arises that the life of the crucible is shortened.

Metal powder is occasionally made to contain an additional element(s) such as sulfur, phosphorus, platinum and rhenium in order to have sinterability and oxidation resistance or in order to adjust catalytic activity or the like. It has been found that when metal powder is made to contain these additional elements by the additional elements being supplied into a reaction vessel in forms of their precursors such as organic compounds or hydrogen compounds, more impurities from the crucible tend to get mixed in the metal powder. In addition, in the case of base metal powder such as nickel or copper, more impurities therefrom tend to get mixed in the base metal powder, and also the crucible deteriorates more, as compared with the case of precious metal powder.

The above-described mixing-in of impurities from a reaction vessel and variation in the amount thereof become a larger problem as reduction in size and improvement in performance of electronic components and the like advance. For example, in the case of nickel powder which is used for inner electrodes of multilayer ceramic electronic components such as multilayer capacitors, a minuscule amount of impurity elements affects sinterability of the electrodes and properties of the ceramic layers, which occasionally causes deterioration or variation increase in properties of the electronic components. In particular, the above elements such as calcium and yttrium are considered to greatly affect the properties of the dielectric ceramic layers, and hence it is necessary that such elements are not contained in the nickel powder or their contents are strictly controlled. Therefore, it is required to prevent these impurities from a reaction vessel from getting mixed in nickel powder as much as possible.

The present invention has been conceived in view of the above problems and circumstances, and a solution is to provide a method for manufacturing metal powder, the method keeping impurity elements from getting mixed in metal powder when the metal powder, base metal powder in particular, is manufactured by a plasma technique, thereby being capable of obtaining extremely high-purity metal powder, and to provide the method for manufacturing metal powder, the method being also capable of improving durability of a reaction vessel such as a crucible.

Means for Solving the Problems

The above problems left to the present invention can be solved by the following means.

1. A method for manufacturing metal powder including: melting at least a portion of a metal starting material in a reaction vessel by utilizing plasma so as to form molten metal; evaporating the molten metal so as to produce a metal vapor; and transferring the metal vapor from the reaction vessel to a cooling tube together with a carrier gas supplied into the reaction vessel so as to cool the metal vapor, and condensing the metal vapor in the cooling tube, thereby producing metal powder, wherein the method further includes supplying an oxygen gas into the reaction vessel.
2. The method for manufacturing metal powder according to the item 1, wherein at least a part of the reaction vessel is formed of zirconia-based ceramic, the part contacting the molten metal.
3. The method for manufacturing metal powder according to the item 1 or 2, wherein the oxygen gas is supplied at an amount of 1500 mL/min or less for a metal powder production amount of 1 Kg/hr.
4. The method for manufacturing metal powder according to any one of the items 1 to 3 further including supplying an additional element selected from sulfur, phosphorus, platinum, rhenium, zinc, tin, aluminum and boron into the reaction vessel.
5. The method for manufacturing metal powder according to the item 4, wherein the additional element is supplied in a form of an organic compound and/or a hydrogen compound.
6. The method for manufacturing metal powder according to any one of the items 1 to 5, wherein the metal powder contains a base metal as a main component.
7. The method for manufacturing metal powder according to any one of the items 1 to 6, wherein the plasma is transferred DC arc plasma.

Advantageous Effects of the Invention

According to the method for manufacturing metal powder of the present invention, supply of an oxide gas into a reaction vessel enables manufacture of metal powder having an extremely small mixed-in amount of impurities from the reaction vessel, and also can prevent material quality of the reaction vessel from degrading and hence tremendously extend the life of the reaction vessel. Further, control on the amount of oxygen to be introduced thereinto to be a specific amount enables reduction in the mixed-in amount of impurities, not causing decrease in productivity or change in properties/conditions of the produced powder.

EMBODIMENT FOR CARRYING OUT THE INVENTION

Figure 1:
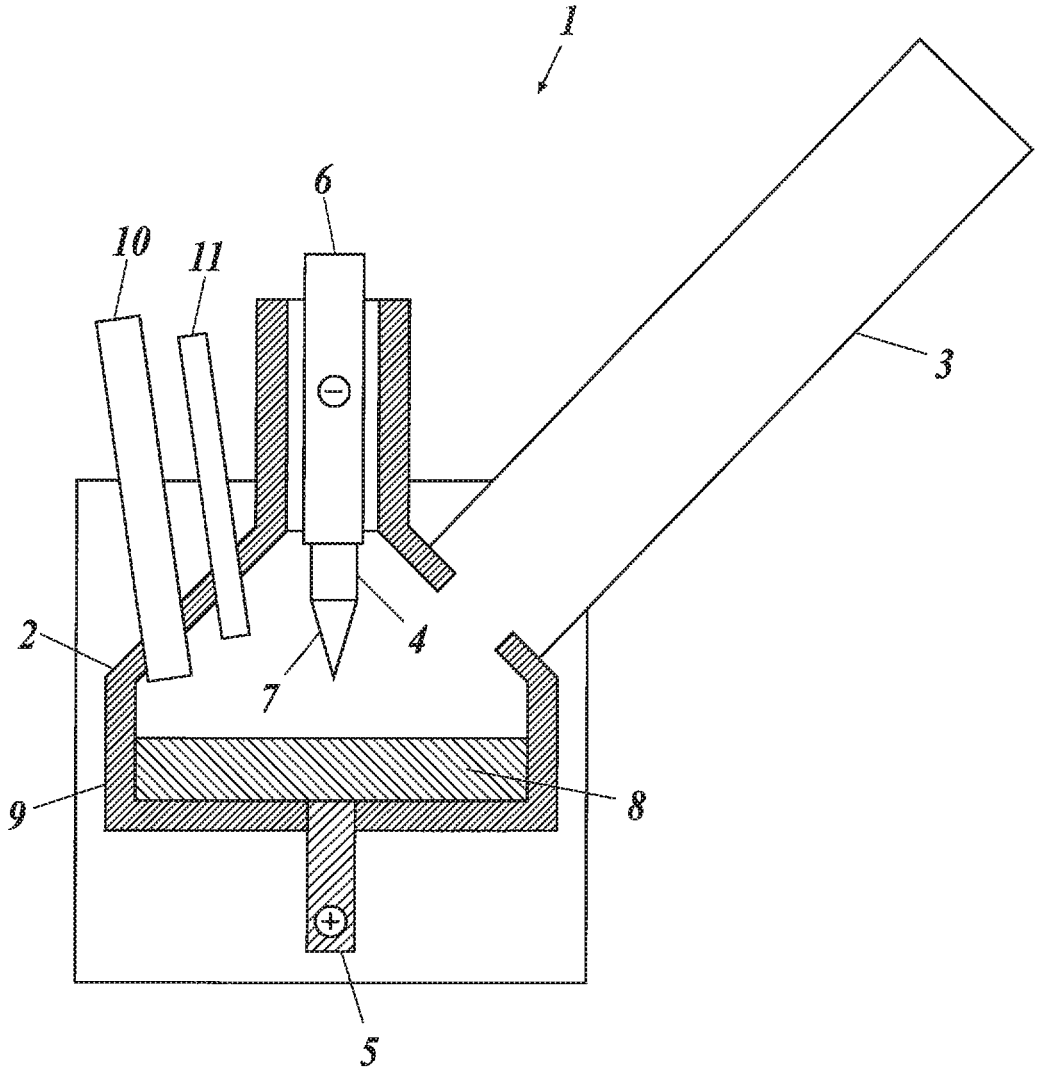
FIG. 1 shows a plasma device used in Examples.
Figure 2:
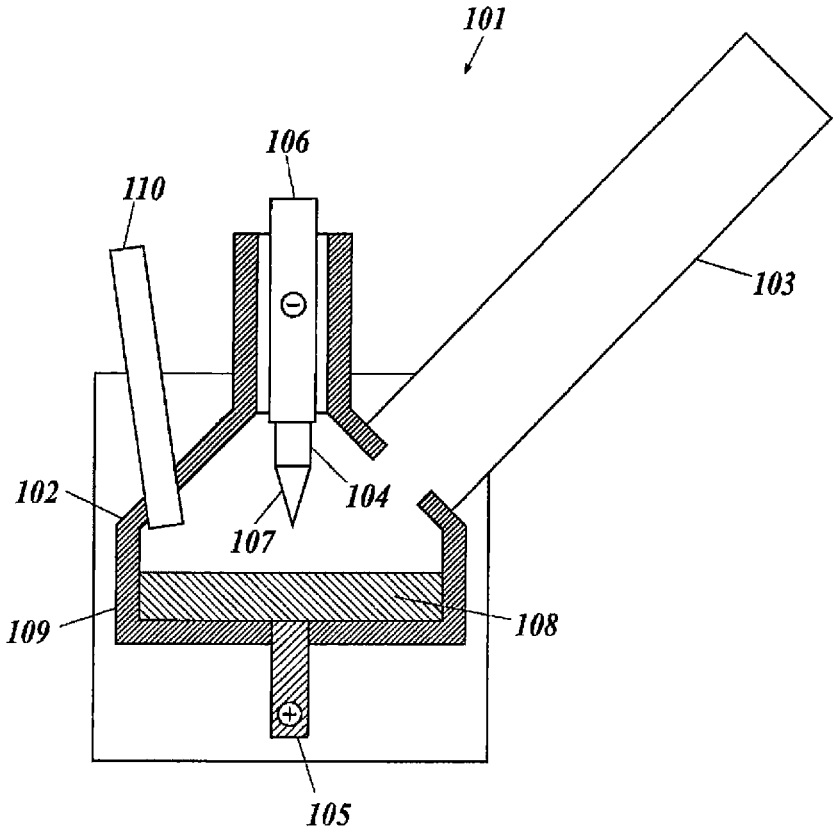
FIG. 2 RELATED ART
FIG. 2 shows a plasma device used in a conventional example.

Metal powder manufactured by a method for manufacturing metal powder of the present invention is exemplified by but not limited to: precious metals such as silver, gold, and platinum group metals; base metals such as nickel, copper, cobalt, iron, tantalum, titanium, and tungsten; and alloys containing any of these. It is particularly preferable that the metal powder be metal powder containing a base metal as a main component so that the effects of the present invention can be enjoyed more.

The "main component" herein means that a percentage of a base metal in the entire metal powder is 50 weight % or more.

In the method for manufacturing metal powder of the present invention, a metal starting material is not particularly limited as long as it is a substance containing a metal component of target metal powder, and usable examples include, other than a pure metal, an alloy, a composite, a mixture and a compound each containing two or more types of metal components. Although there is no special limitation, it is preferable, in terms of easy handling, to use a granular or massive metal material or alloy material having a size of about several mm to several ten mm.

Hereinafter, a process of the present invention is described with an example.

A metal as a staring material is supplied from a starting-material feed port into a reaction vessel of a plasma device.

Into the reaction vessel, oxygen and a dilute gas, which is not essential, are supplied. The metal starting material is melted by plasma in the reaction vessel and accumulated at a crucible part, which is the lower part of the reaction vessel, as molten metal. The molten metal is further heated by the plasma to evaporate, so that a metal vapor is produced. The produced metal vapor is transferred from the reaction vessel to a cooling tube by a carrier gas containing a plasma gas used for producing the plasma and the dilute gas supplied as needed, and cooled and condensed in the cooling tube. Thus, metal powder is produced.

Material which constitutes the reaction vessel is not limited, and a refractory material conventionally used for plasma devices, such as graphite or ceramic, is used therefor. In particular, when at least the crucible part is made of an oxide ceramic material, zirconia-based ceramic in particular, the effects of the present invention are remarkable.

As the plasma gas and the dilute gas, an inert gas or a reducing gas usually used in manufacturing metal powder is used. Examples thereof include argon, helium, nitrogen, ammonia, methane, and a mixture of any of these.

The oxygen gas maybe supplied as a gas containing oxygen, such as air or a mixed gas of an inert gas and oxygen, instead of a pure oxygen gas. The oxygen may be mixed with the dilute gas and supplied into the reaction vessel, or may be unmixed with the dilute gas and supplied into the reaction vessel from an introduction port which is different from that for the dilute gas.

Although the reason why the amount of impurities is reduced by supply of an oxygen gas into a reaction vessel is not completely clear, it may be considered as described below with a case taken as an example, the case where nickel powder is manufactured using metal nickel as a metal starting material and using a reaction vessel made of stabilized zirconia (hereinafter, may be referred to as a "zirconia crucible" indicating the crucible part).

In a conventional method, at a solid-liquid interface where the zirconia crucible and high-temperature molten nickel come into contact with each other, oxygen inside the crucible moves into the molten nickel, and metals produced thereby, such as zirconium, calcium and yttrium, dissolve in the molten nickel, so that impurities in the nickel powder to be produced increase. Because zirconia has a property as a solid electrolyte at a high temperature, 1000° C. or more in particular, and has high ion conductivity, the eluted-and-dissolved amount of the oxygen and the metals becomes large by the oxygen moving from the inside of the crucible to the solid-liquid interface. In the present invention, however, it is assumed that oxygen introduced into the reaction vessel dissolves in the molten nickel, and an oxygen concentration in the molten nickel becomes high, so that the oxygen from the crucible is kept from moving, and the amount of impurities derived from the crucible in the produced nickel powder reduces.

Regarding an oxygen gas supply, even with a small amount of about 0.05 mL/min as the supply for a metal powder production rate of 1 Kg/hr, the effect of reducing impurities is observed.

In the present invention, an oxygen supply which is necessary to obtain the effect of reducing impurities equivalent to the above is approximately proportional to a supply rate of a metal starting material (metal powder production rate). Hence, hereinafter, the oxygen supply is expressed as an amount for a metal powder production rate of 1 Kg/hr. The oxygen gas supply is expressed as a flow rate of an oxygen gas at 25° C. and 1 atm. It is particularly preferable that oxygen be supplied at an amount of 0.1 mL/min or more so that the remarkable effects are obtained.

On the other hand, when the oxygen gas supply is large, problems arise. For example, the manufacturing efficiency decreases because too much oxygen dissolves in molten metal and the surface of the molten metal is oxidized or plasma becomes unstable; a heat insulating material or the like used for the reaction vessel is burned; and, in DC plasma, an electrode metal is oxidized. Further, of the supplied oxygen, oxygen which has not been consumed either to keep the crucible components from being eluted, which is described above, or to decompose compounds, which is described below, constitutes a portion of a carrier gas. Hence, it is necessary to adjust the oxygen gas supply to an amount with which oxidation does not occur when the metal vapor is condensed in the cooling tube and thereby metal powder is precipitated. Although it differs depending on the type of a target metal and additional elements described below, it is preferable that the oxygen gas supply not exceed a maximum of 1500 mL/min in the case where there is no additional element described below. It is particularly preferable that an oxygen gas be supplied at an amount of 0.1 to 1000 mL/min so that the above problems hardly occur and the remarkable effects are obtained.

As described above, impurities tend to increase when, in order to make metal powder contain an element (s) such as sulfur, phosphorus, platinum, rhenium, zinc, tin, aluminum and boron as an additional element(s), compounds of these additional elements, particularly organic compounds, hydrogen compounds or the like, are supplied into the plasma reaction vessel. In this case, supply of oxygen is preferable because the effect of reducing impurities thereby is particularly remarkable and the effects of the present invention can be enjoyed more. That is, although it is assumed that elution of oxygen from the crucible and dissolution thereof in molten metal, which is described above, more easily occur because the above organic compounds or hydrogen compounds decompose in a high-temperature gaseous phase and show reducibility, supply of oxygen cancels out the reducibility and is extremely effective in reducing impurities.

It is also considered that oxygen has an effect of promoting decomposition of these compounds so as to make it easy for metal powder to contain an additional element(s). Hence, it is preferable that oxygen be supplied more than a stoichiometric amount necessary for decomposition of the above organic compounds or hydrogen compounds.

Usable examples of the above organic compounds include but are not limited to: in the case of sulfur, thiols such as methanethiol and ethanethiol; mercaptan compounds such as mercaptoethanol and mercaptobutanol; thiophenes such as benzothiophene; and thiazoles.

In the case of phosphorus, usable examples thereof include: phosphines such as triphenylphosphine, methylphenylphosphine and trimethylphosphine; and phosphorane.

In the case of platinum, rhenium, zinc, tin, aluminum and boron, examples of the organic compounds include: carboxylates; amine complexes; phosphine complexes; mercaptides; and organic derivatives of rhenic acid.

Usable examples of the above hydrogen compounds include: hydrides such as hydrogen sulfide, aluminum hydride, and diborane; and organic derivatives thereof.

Further, in the present invention, it is preferable that the above plasma be transferred DC arc plasma so that the effects of the present invention can be enjoyed more.

EXAMPLES

Next, the present invention is detailed with Examples. However, the present invention is not limited thereto. In Examples below, a flow rate of each gas is expressed by a flow rate of a gas at 25° C. and 1 atm, as with oxygen.

In Examples described below, a transferred DC arc plasma device 1 shown in FIG. 1 was used as a plasma device.

As a reaction vessel 2 of the device, a reaction vessel made of calcium stabilized zirconia is used. At the upper part of the reaction vessel 2, a plasma torch 4 is placed, and a plasma producing gas is supplied to the plasma torch 4 through a not-shown supply tube. The plasma torch 4 produces plasma 7 with a cathode 6 as the negative pole and a not-shown anode provided inside the plasma torch 4 as the positive pole, and after that, the positive pole is transferred to an anode 5, so that the plasma 7 is produced between the cathode 6 and the anode 5. At least a portion of a metal starting material which is supplied from a not-shown starting-material feed port to a crucible part 9 of the reaction vessel 2 is melted by heat of the plasma 7, so that molten metal 8 of the metal is produced. In addition, a portion of the molten metal 8 is evaporated by heat of the plasma 7, so that a metal vapor is produced.

Into the reaction vessel 2, a dilute gas is supplied from a dilute gas supply unit 10. The dilute gas is used as a carrier gas together with the plasma producing gas for carrying the metal vapor to a cooling tube 3. Oxygen is supplied thereinto by introducing air from an oxygen supply unit 11 which is different from the dilute gas supply unit 10.

The metal vapor produced in the reaction vessel 2 is transferred to the cooling tube 3 by the carrier gas containing the plasma producing gas and the dilute gas, and cooled and condensed in the cooling tube 3. Thus, metal powder is produced.

First Example

Into the reaction vessel of the plasma device, a metal nickel mass was supplied as a metal starting material at a supply rate of about 3.0 to 4.0 Kg/hr, argon as a plasma producing gas and a nitrogen gas as a dilute gas were supplied at a flow rate of 70 L/min and a flow rate of 630 to 650 L/min, respectively, and air was supplied at a flow rate with which an oxygen amount became each of those shown in TABLE 1. The device was operated for 500 hours under a condition of plasma output of about 100 kW. Thus, nickel powder was manufactured.

A nickel powder production rate (supply rate of the metal nickel mass); an oxygen supply into the reaction vessel; and a specific surface area, Ca and Zr contents as impurities, and an oxygen content of the obtained nickel powder are all shown in TABLE 1.

The specific surface area of the powder was measured by BET, the Ca and Zr contents were measured with a fluorescence X-ray spectrometer (ZSX100e, manufactured by Rigaku Corporation), and the oxygen content was measured with an oxygen/nitrogen analyzer (EMGA-920, manufactured by Horiba, Ltd.).

TABLE 1

| | NICKEL | | OXYGEN SUPPLY | NICKEL POWDER CHARACTERISTICS | | | |
|---|---|---|---|---|---|---|---|
| | POWDER PRODUCTION | OXYGEN | (mL/min) FOR NICKEL POWDER | SPECIFIC SURFACE | AMOUNT OF IMPURITIES | | OXYGEN |
| TEST No. | RATE (Kg/hr) | SUPPLY (mL/min) | PRODUCTION RATE OF 1 kg/h | AREA ($m^2/g$) | Ca (ppm) | Zr (ppm) | CONTENT (weight %) |
| 1 | 4.0 | 0 | 0 | 3.78 | 123 | 128 | 1.21 |
| 2 | 3.9 | 0.4 | 0.1 | 3.96 | 104 | 68 | 1.19 |
| 3 | 3.6 | 3.6 | 1.0 | 3.81 | 71 | 28 | 1.14 |
| 4 | 3.4 | 34 | 10 | 3.56 | 63 | 29 | 0.99 |
| 5 | 3.7 | 370 | 100 | 3.88 | 50 | 27 | 1.16 |
| 6 | 4.0 | 4000 | 1000 | 3.66 | 45 | 28 | 1.10 |
| 7 | 3.2 | 4800 | 1500 | 3.80 | 83 | 35 | 2.10 |
| 8 | 2.4 | 4800 | 2000 | 3.81 | 108 | 70 | 3.03 |

As it is clear from the result shown in TABLE 1, when the oxygen gas was supplied into the reaction vessel, the amount of impurities was reduced as compared with when no oxygen gas was supplied thereinto (Test No. 1).

In Test No. 8 in which the oxygen supply exceeded 1500 mL/min, although the effect of reducing the amount of impurities was observed, the plasma became unstable. As a result of reducing the supply of the metal nickel in order to maintain the plasma output, the manufacturing efficiency decreased, and also the particle shape and the particle size of the produced nickel powder varied widely.

Second Example

Nickel powder was manufactured in much the same way as First Example, except that a hydrogen sulfide ($H_2S$) gas was supplied at a rate of 350 mL/min (0.041 mol/min) together with air from the oxygen supply unit 11 into the reaction vessel in order to dope the nickel powder with sulfur.

A nickel powder production rate (supply rate of the metal nickel mass); an oxygen supply into the reaction vessel; and a specific surface area, Ca and Zr contents as impurities, and oxygen and sulfur contents of the obtained nickel powder are shown in TABLE 2. The sulfur content was measured with a carbon/sulfur analyzer (EMIA-320V, manufactured by Horiba, Ltd.).

TABLE 2

| TEST No. | NICKEL POWDER PRODUCTION RATE (Kg/hr) | OXYGEN SUPPLY (mL/min) | OXYGEN SUPPLY (mL/min) FOR NICKEL POWDER PRODUCTION RATE OF 1 kg/h | NICKEL POWDER CHARACTERISTICS: SPECIFIC SURFACE AREA ($m^2/g$) | AMOUNT OF IMPURITIES Ca (ppm) | AMOUNT OF IMPURITIES Zr (ppm) | OXYGEN CONTENT (weight %) | SULFUR CONTENT (ppm) |
|---|---|---|---|---|---|---|---|---|
| 9 | 4.0 | 0 | 0 | 4.6 | 150 | 156 | 1.38 | 1103 |
| 10 | 3.6 | 0.4 | 0.1 | 4.5 | 118 | 77 | 1.40 | 1110 |
| 11 | 3.3 | 3.3 | 1 | 4.7 | 87 | 34 | 1.35 | 1192 |
| 12 | 4.0 | 200 | 50 | 4.6 | 83 | 38 | 1.38 | 1096 |
| 13 | 3.7 | 370 | 100 | 4.7 | 60 | 33 | 1.43 | 1154 |
| 14 | 3.1 | 620 | 200 | 5.0 | 67 | 40 | 1.48 | 1196 |
| 15 | 3.9 | 3900 | 1000 | 4.7 | 67 | 35 | 1.43 | 1180 |

As it is clear from the result shown in TABLE 2, when oxygen was supplied into the reaction vessel, the effect of reducing impurities was remarkable.

Third Example

Copper powder was manufactured in the same way as Second Example, except that a metal copper mass was supplied as a metal starting material at a supply rate of about 6.5 to 7.5 Kg/hr into the reaction vessel of the plasma device, and liquid triphenylphosphine was supplied at a rate of 1 mL/min (0.00419 mol/min) together with air from the oxygen supply unit 11 into the reaction vessel in order to dope the copper powder with phosphorus.

A copper powder production rate (supply rate of the metal copper); an oxygen supply into the reaction vessel; and a specific surface area, Ca and Zr contents as impurities, and oxygen and phosphorus contents of the obtained copper powder are shown in TABLE 3. The phosphorus content was measured with a fluorescence X-ray spectrometer (ZSX100e, manufactured by Rigaku Corporation).

TABLE 3

| TEST No. | COPPER POWDER PRODUCTION RATE (Kg/hr) | OXYGEN SUPPLY (mL/min) | OXYGEN SUPPLY (mL/min) FOR COPPER POWDER PRODUCTION RATE OF 1 kg/h | COPPER POWDER CHARACTERISTICS: SPECIFIC SURFACE AREA ($m^2/g$) | AMOUNT OF IMPURITIES Ca (ppm) | AMOUNT OF IMPURITIES Zr (ppm) | OXYGEN CONTENT (weight %) | PHOSPHORUS CONTENT (ppm) |
|---|---|---|---|---|---|---|---|---|
| 16 | 6.8 | 0 | 0 | 2.5 | 147 | 35 | 0.30 | 3 |
| 17 | 7.1 | 0.71 | 0.1 | 2.5 | 109 | 22 | 0.41 | 17 |
| 18 | 7.4 | 7.4 | 1 | 2.7 | 85 | 19 | 0.60 | 26 |
| 19 | 7.3 | 73 | 10 | 2.6 | 82 | 24 | 0.71 | 111 |
| 20 | 6.8 | 3400 | 500 | 2.7 | 74 | 23 | 1.30 | 283 |

As it is clear from the result shown in TABLE 3, when oxygen was supplied into the reaction vessel, the effect of reducing impurities was remarkable.

In Examples, the transferred DC arc plasma device was used. However, the present invention is not limited thereto, and, for example, a radio-frequency induction plasma device or a microwave heating plasma device may be used.

Further, in Examples, oxygen was supplied from the oxygen supply unit different from the dilute gas supply unit, but may be supplied together with a dilute gas.

INDUSTRIAL APPLICABILITY

The present invention is suitably applicable to a manufacturing method of metal powder for manufacturing metal powder by a plasma technique, particularly the method keeping impurity elements from getting mixed in metal powder, thereby obtaining extremely high-purity metal powder.

EXPLANATION OF REFERENCE NUMERALS

1 Plasma Device
2 Reaction Vessel
3 Cooling Tube
4 Plasma Torch
5 Anode
6 Cathode
7 Plasma
8 Molten Metal
9 Crucible Part
10 Dilute Gas Supply Unit
11 Oxygen Supply Unit

The invention claimed is:

1. A method for manufacturing metal powder comprising:

melting at least a portion of a metal starting material in a reaction vessel by utilizing plasma so as to form molten metal;

evaporating the molten metal so as to produce a metal vapor;

transferring the metal vapor from the reaction vessel to a cooling tube together with a carrier gas supplied into the reaction vessel so as to cool the metal vapor; and condensing the metal vapor in the cooling tube, thereby producing metal powder, wherein the method further comprises supplying an oxygen gas into the reaction vessel, during melting, and at least a part of the reaction vessel is formed of an oxide ceramic material, the part contacting the molten metal.

2. The method for manufacturing metal powder according to claim 1, wherein the oxide ceramic material is zirconia-based ceramic.

3. The method for manufacturing metal powder according to claim 1, wherein the oxygen gas is supplied at an amount of 1500 mL/min or less for a metal powder production amount of 1 Kg/hr.

4. The method for manufacturing metal powder according to claim 1 further comprising supplying an additional element selected from sulfur, phosphorus, platinum, rhenium, zinc, tin, aluminum and boron into the reaction vessel, during melting.

5. The method for manufacturing metal powder according to claim 4, wherein the additional element is supplied in a form of an organic compound and/or a hydrogen compound.

6. The method for manufacturing metal powder according to claim 1, wherein the metal powder contains 50% by weight or more of a base metal and the base metal is nickel, copper, cobalt, iron, tantalum, titanium or tungsten.

7. The method for manufacturing metal powder according to claim 1, wherein the plasma is transferred DC arc plasma.

8. The method for manufacturing metal powder according to claim 1, wherein the oxygen gas is supplied at an amount of 0.05 mL/min or more for a metal powder production amount of 1 Kg/hr.

* * * * *